US009645533B2

(12) United States Patent
Ishigai et al.

(10) Patent No.: US 9,645,533 B2
(45) Date of Patent: May 9, 2017

(54) IMAGE FORMING APPARATUS WITH COOLING UNIT FOR COOLING NON-SHEET PASSING REGION

(71) Applicant: Konica Minolta, Inc., Chiyoda-ku (JP)

(72) Inventors: Takuya Ishigai, Hino (JP); Toru Hayase, Toyohashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 65 days.

(21) Appl. No.: 13/868,496

(22) Filed: Apr. 23, 2013

(65) Prior Publication Data

US 2013/0279932 A1 Oct. 24, 2013

(30) Foreign Application Priority Data

Apr. 24, 2012 (JP) ..... 2012-098637

(51) Int. Cl.
*G03G 15/20* (2006.01)

(52) U.S. Cl.
CPC ..... *G03G 15/2039* (2013.01); *G03G 15/2017* (2013.01); *G03G 15/2042* (2013.01)

(58) Field of Classification Search
CPC ..... G03G 15/2017; G03G 15/2021; G03G 15/2078; G03G 15/2042; G03G 15/2046
(Continued)

(56) References Cited

U.S. PATENT DOCUMENTS 5,750,961 A * 5/1998 Schug et al. ..... 219/497
2005/0163523 A1* 7/2005 Omata et al. ..... 399/69
(Continued)

FOREIGN PATENT DOCUMENTS

CN 1645272 A 7/2005
CN 1867873 A 11/2006
(Continued)

OTHER PUBLICATIONS

Office Action (Notification of Reasons for Refusal) issued on Aug. 5, 2014, by the Japanese Patent Office in corresponding Japanese Patent Application No. 2012-098637 and an English translation of the Office Action. (5 pages).
(Continued)

*Primary Examiner* — David Gray
*Assistant Examiner* — Andrew V Do
(74) *Attorney, Agent, or Firm* — Buchanan Ingersoll Rooney PC

(57) ABSTRACT

A fixing device thermally fixing an unfixed image by pressing a recording sheet against a heating rotating body using a resistance heating element as a heat source, comprising: a temperature monitoring unit monitoring temperature in a sheet passing region and in a non-sheet passing region of the heating rotating body; a power supply unit supplying power to the resistance heating element so that the temperature in the sheet passing region is maintained at a target temperature during thermal fixing; a cooling unit cooling the non-sheet passing region; and a control unit controlling cooling so that (i) electrical resistivity of the resistance heating element is lower in a region corresponding to the non-sheet passing region than in a region corresponding to the sheet passing region and (ii) an absolute value of a temperature difference between the sheet passing region and the non-sheet passing region does not exceed an allowable temperature difference.

8 Claims, 12 Drawing Sheets

(58) Field of Classification Search
USPC ..... 399/69
See application file for complete search history.

(56) References Cited

U.S. PATENT DOCUMENTS

| | | | | |
|---|---|---|---|---|
| 2007/0019063 | A1 | 1/2007 | Yasuda et al. | |
| 2007/0059012 | A1 | 3/2007 | Tomine et al. | |
| 2009/0230114 | A1* | 9/2009 | Taniguchi | G03G 15/2042 219/216 |
| 2010/0104340 | A1 | 4/2010 | Kitadai et al. | |
| 2010/0180785 | A1* | 7/2010 | Arimoto et al. | 101/424.1 |
| 2011/0158671 | A1* | 6/2011 | Nishiyama | 399/69 |

FOREIGN PATENT DOCUMENTS

| | | | |
|---|---|---|---|
| JP | 61-011774 | A | 1/1986 |
| JP | 10-074017 | A | 3/1998 |
| JP | 2007-079040 | A | 3/2007 |
| JP | 2009-63815 | A | 3/2009 |
| JP | 2009-109997 | A | 5/2009 |
| JP | 2010-107577 | A | 5/2010 |
| JP | 2011-107447 | A | 6/2011 |
| JP | 2011-128254 | A | 6/2011 |
| JP | 2011-150317 | A | 8/2011 |
| JP | 2011-248054 | A | 12/2011 |

OTHER PUBLICATIONS

Office Action (The First Office Action) issued on Feb. 28, 2015, by the Chinese Patent Office in corresponding Chinese Patent Application No. 201310146010.1, and an English Translation of the Office Action. (16 pages).

Office Action (Decision to Grant a Patent) issued on Feb. 17, 2015, by the Japanese Patent Office in corresponding Japanese Patent Application No. 2012-098637, and an English Translation of the Office Action. (3 pages).

* cited by examiner

FIG. 8

| Surface temperature (°C) | | Resistance (Ω) | | | Amount of current (A) | Power supply (W) | | | Intermittent current-application ratio (%) | Power consumption (Wh) | | | | Total power consumption (Wh) |
|---|---|---|---|---|---|---|---|---|---|---|---|---|---|---|
| A Sheet passing region | B Non-sheet passing region | C Sheet passing region | D Non-sheet passing region | E Entire region | F | G Sheet passing region | H Non-sheet passing region | I Entire region | J | K Sheet passing region | L Non-sheet passing region | M Entire region | N Cooling fan | O (M + N) |
| 150 | 140 | 3 | 6.95 | 9.95 | 10.05 | 303 | 702 | 1005 | 49.5 | 150 | 348 | 498 | 4 | 502 |
| 150 | 150 | 3 | 7.00 | 10.00 | 10.00 | 300 | 700 | 1000 | 50.0 | 150 | 350 | 500 | 4 | 504 |
| 150 | 165 | 3 | 7.07 | 10.07 | 9.93 | 296 | 697 | 993 | 50.7 | 150 | 354 | 504 | 4 | 508 |

FIG. 10

| Surface temperature (°C) | | Resistance (Ω) | | | Amount of current (A) | Power supply (W) | | | Intermittent current-application ratio (%) | Power consumption (Wh) | | | | Total power consumption (Wh) |
|---|---|---|---|---|---|---|---|---|---|---|---|---|---|---|
| A Sheet passing region | B Non-sheet passing region | C Sheet passing region | D Non-sheet passing region | E Entire region | F | G Sheet passing region | H Non-sheet passing region | I Entire region | J | K Sheet passing region | L Non-sheet passing region | M Entire region | N Cooling fan | O (M + N) |
| 150 | 140 | 3 | 7.10 | 10.10 | 9.91 | 294 | 696 | 991 | 51.0 | 150 | 355 | 505 | 4 | 509 |
| 150 | 150 | 3 | 7.00 | 10.00 | 10.00 | 300 | 700 | 1000 | 50.0 | 150 | 350 | 500 | 4 | 504 |
| 150 | 165 | 3 | 6.86 | 9.86 | 10.14 | 309 | 706 | 1014 | 48.6 | 150 | 343 | 493 | 4 | 497 |

IMAGE FORMING APPARATUS WITH COOLING UNIT FOR COOLING NON-SHEET PASSING REGION

This application is based on application No. 2012-98637 filed in Japan, the contents of which are hereby incorporated by reference.

BACKGROUND OF THE INVENTION (1) Field of the Invention

The present invention relates to an image forming apparatus, such as a printer and a copier, that includes a fixing device, and, in particular, to technology for reducing power consumption when a heating rotating body using a resistance heating element as a heat source is used to thermally fix an unfixed image.

(2) Related Art

In recent years, in order to reduce energy and increase heating speed of a fixing device, a fixing device that thermally fixes an unfixed image formed on a recording sheet by using a heating rotating body using a resistance heating element as a heat source has been proposed as a fixing device included in an image forming apparatus such as a printer and a copier (see for example Japanese Patent Application Publication No. 2009-109997.)

Use, as the heating rotating body, of an endless heating belt including a resistance heating layer can reduce the heat capacity and a distance between the heating layer and the recording sheet, thereby increasing efficiency of heat transfer from the heating layer. As a result, power consumption of the fixing device and heating time required to warm up the fixing device can be reduced.

There are two types of the resistance heating element: a positive temperature coefficient (PTC) resistance heating element, whose electrical resistivity increases with increasing temperature, and a negative temperature coefficient (NTC) resistance heating element, whose electrical resistivity decreases with increasing temperature.

When thermal fixing of an unfixed image formed on a small-sized recording sheet is continually performed by using such a heating rotating body using a resistance heating element as a heat source, since a surface temperature in a sheet passing region of the heating rotating body (hereinafter, referred to as the "sheet passing region") decreases upon contact with the recording sheet, power is supplied to the heating rotating body as needed to maintain the surface temperature at a target temperature at which thermal fixing is successfully performed. By the power supply, the temperature in the sheet passing region is maintained at the target temperature, but a non-sheet passing region of the heating rotating body (hereinafter, referred to as the "non-sheet passing region") is heated to a temperature higher than the target temperature, as the heating rotating body does not contact the recording sheet in the non-sheet passing region, and thus the temperature in the non-sheet passing region does not decrease.

When the non-sheet passing region is heated to the temperature higher than the target temperature as described above, if the PTC resistance heating element is used, the electrical resistivity of the resistance heating element increases in the non-sheet passing region, and, accordingly, a power consumption rate per unit area becomes higher in the non-sheet passing region than in the sheet passing region. This results in a problem because, as an area of the non-sheet passing region increases (as a size of a recording sheet used for thermal fixing decreases), a ratio of the non-sheet passing region to the entire region including the sheet passing region and the non-sheet passing region (hereinafter, referred to as the "entire region") increases, and the total power consumption in the entire region increases accordingly.

If the NTC resistance heating element is used, a similar problem is caused because, when the fixing device has a function to cool the non-sheet passing region by using a cooling fan and the like, and the non-sheet passing region is excessively cooled to prevent overheating in the non-sheet passing region, the power consumption rate per unit area becomes higher in the non-sheet passing region than in the sheet passing region.

In addition, if there is an extreme temperature difference between the sheet passing region and the non-sheet passing region, when the thermal fixing onto a large-sized recording sheet immediately follows the thermal fixing onto a small-sized recording sheet, a difference in image quality is caused on the large-sized recording sheet between regions corresponding to the sheet passing region and the non-sheet passing region of the small-sized recording sheet. This is problematic because a high-quality image cannot be obtained. If the temperature difference increases too much so that the electrical resistivity decreases in the non-sheet passing region, the amount of current flowing through the resistance heating element might exceed a standard value (e.g. rated current.)

Furthermore, when the NTC resistance heating element is used, if there is an extreme temperature difference between the sheet passing region and the non-sheet passing region due to overheating in the non-sheet passing region, parts of the fixing device might decrease in durability or be damaged due to heat.

SUMMARY OF THE INVENTION

In order to solve the above-mentioned problems, a fixing device according to one aspect of the present invention is a fixing device that thermally fixes an unfixed image onto a recording sheet by pressing the recording sheet against a heating rotating body during passage of the recording sheet, the heating rotating body using, as a heat source, a resistance heating element whose electrical resistivity varies with temperature, the fixing device comprising: a temperature monitoring unit configured to monitor temperature in a sheet passing region and in a non-sheet passing region of the heating rotating body; a power supply unit configured to supply power to the resistance heating element so that the temperature in the sheet passing region is maintained at a target temperature during thermal fixing; a cooling unit configured to cool the non-sheet passing region; and a control unit configured to control cooling operation of the cooling unit according to the temperature in the non-sheet passing region during thermal fixing so that (i) the electrical resistivity of the resistance heating element is lower in a region corresponding to the non-sheet passing region than in a region corresponding to the sheet passing region and (ii) an absolute value of a temperature difference between the sheet passing region and the non-sheet passing region does not exceed an allowable temperature difference.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIG. 8 is a table showing results of research in which the fixing device according to an embodiment performs thermal fixing onto a recording sheet having a size corresponding to a minimum sheet passing range of the heating rotating body to examine a relationship between temperature in the non-sheet passing region and the power consumption;

FIG. 10 is a table showing results of research in which thermal fixing onto the recording sheet having the size corresponding to the minimum sheet passing range is performed by using the heating rotating body using the NTC resistance heating layer to examine a relationship between temperature in the non-sheet passing region and the power consumption;

DESCRIPTION OF PREFERRED EMBODIMENTS

The following describes an embodiment of an image forming apparatus according to one aspect of the present invention by taking, as an example, a case where it is applied to a tandem-type color digital printer (hereinafter, simply referred to as a "printer".)

[1] Structure of Printer

Figure 1:
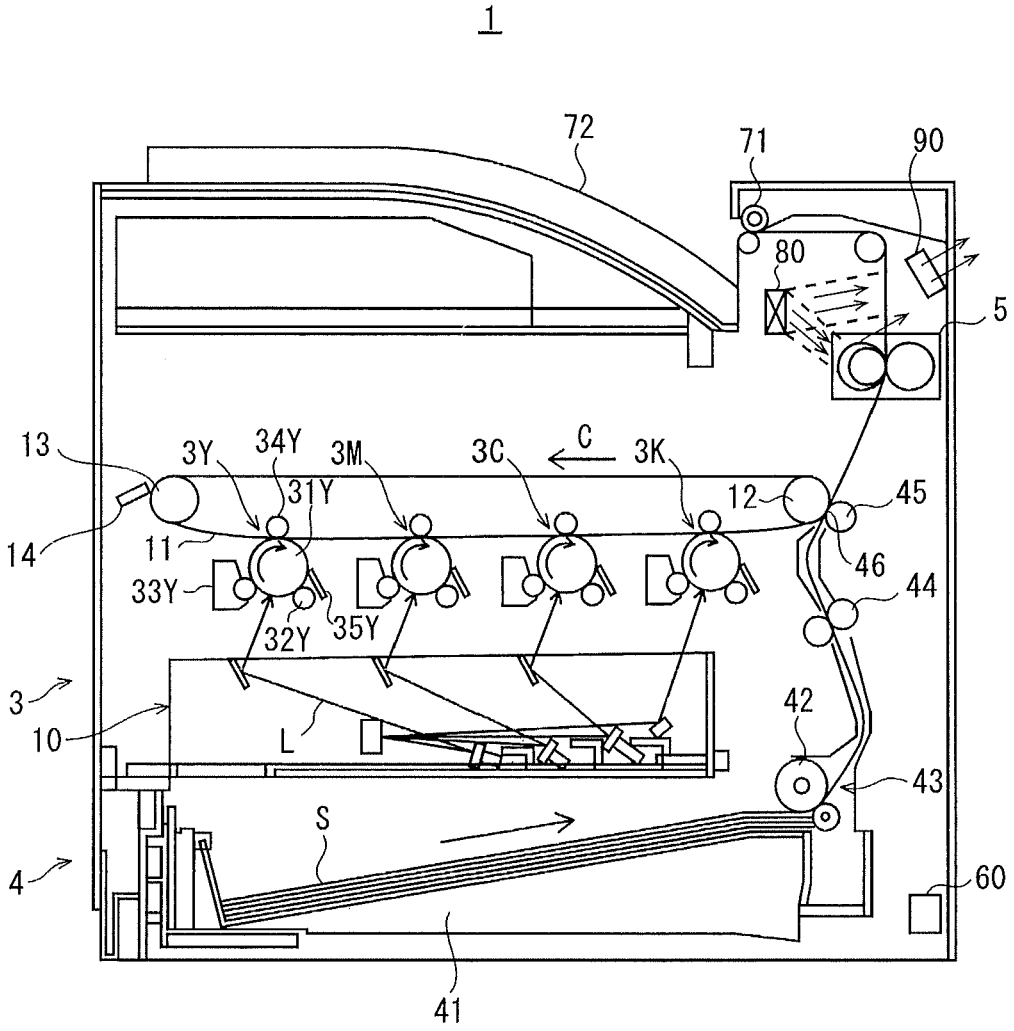
FIG. 1 illustrates the structure of a printer 1.

The structure of the printer according to the present embodiment is described first. FIG. 1 illustrates the structure of the printer according to the present embodiment. As illustrated in FIG. 1, the printer 1 includes an image process unit 3, a paper feed unit 4, a fixing device 5, and a control unit 60.

The printer 1 is connected to a network (e.g. LAN (Local Area Network)). Upon receiving an instruction to perform printing from an external terminal device (not illustrated) or an operation panel (not illustrated), the printer 1 forms toner images of respective colors including yellow, magenta, cyan, and black according to the received instruction, and forms a full color image by multi-transferring the toner images, thereby performing printing on a recording sheet.

Reproduction colors of yellow, magenta, cyan, and black are hereinafter respectively represented by Y, M, C, and K. Y, M, C, and K are added to reference signs of components relating to respective reproduction colors. The image process unit 3 includes imaging units 3Y, 3M, 3C, and 3K, an exposure unit 10, an intermediate transfer belt 11, and a secondary transfer roller 45.

The following mainly describes the structure of the imaging unit 3Y, since the imaging units 3Y, 3M, 3C, and 3K have similar structures. The imaging unit 3Y includes a photoreceptor drum 31Y, and a charger 32Y, a developing unit 33Y, a primary transfer roller 34Y, and a cleaner 35Y for cleaning the photoreceptor drum 31Y that are disposed around the photoreceptor drum 31Y. The imaging unit 3Y forms a toner image of Y color on the photoreceptor drum 31Y.

The developing unit 33Y is disposed to face the photoreceptor drum 31Y, and conveys charged toner to the photoreceptor drum 31Y. The intermediate transfer belt 11 is an endless belt that is bridged in a tensioned state between a drive roller 12 and a driven roller 13, and is driven to rotate in a direction of an arrow C. In the vicinity of the driven roller 13, a cleaner 14 for removing toner remaining on the intermediate transfer belt is disposed.

The exposure unit 10 includes a light-emitting element such as a laser diode. The exposure unit 10 emits laser light L for forming images of Y, M, C, and K colors by a drive signal transmitted from the control unit 60, and performs exposure scanning on the photoreceptor drums included in the respective imaging units 3Y, 3M, 3C, and 3K. By the exposure scanning, an electrostatic latent image is formed on the photoreceptor drum 31Y charged by the charger 32Y. An electrostatic latent image is formed in a similar manner on each of the photoreceptor drums included in the respective imaging units 3M, 3C, and 3K.

The electrostatic latent images formed on the respective photoreceptor drums are developed by the developing units included in the respective imaging units 3Y, 3M, 3C, and 3K, so that toner images of respective colors are formed on the respective photoreceptor drums. The foamed toner images are sequentially primary-transferred by the respective primary transfer rollers included in the imaging units 3Y, 3M, 3C, and 3K (in FIG. 1, only a primary transfer roller included in the imaging unit 3Y is assigned with a reference sign 34Y, and reference signs of the other primary transfer rollers are omitted) at different timings so that the formed toner images are primary-transferred onto the same position on the intermediate transfer belt 11 in layers. The toner images formed on the intermediate transfer belt 11 are then collectively secondary-transferred onto a recording sheet by electrostatic force applied by the secondary transfer roller 45. The recording sheet onto which the toner images are secondary-transferred is conveyed to the fixing device 5, and the fixing device 5 thermally fixes, onto the recording sheet, the toner images (unfixed images) on the recording sheet by applying heat and pressure. The recording sheet is then ejected by ejection rollers 71 onto an ejection tray 72.

In the vicinity of the fixing device 5, a cooling fan 80 is disposed to cool non-sheet passing regions of an outer circumferential surface of a heating rotating body 51 (described later) (hereinafter, referred to as the "non-sheet passing regions") included in the fixing device 5 and a surface of a recording sheet ejected from the fixing device 5 after thermal fixing. Cooling air sent from the cooling fan 80 is guided by ducts indicated by dotted lines in FIG. 1 to the non-sheet passing regions at both ends of the heating rotating body 51 along the rotational axis of the heating rotating body 51 and a recording sheet conveyance path located downstream in a sheet conveyance direction from the fixing device 5. After guided to the recording sheet conveyance path and the non-sheet passing regions at both ends of the heating rotating body 51, the cooling air sent from the cooling fan 80 is emitted to the outside of the printer 1 by an exhaust fan 90 disposed, above the fixing device 5, downstream in the sheet conveyance direction from the fixing device 5 (at an upper right corner of the printer 1 in FIG. 1.)

The paper feed unit 4 includes a paper feed cassette 41 for housing therein one or more recording sheets (assigned with a reference sign S in FIG. 1), a pick-up roller 42 that picks up the recording sheets housed in the paper feed cassette 41 one at a time to a conveyance path 43, and timing rollers 44 that adjust a timing at which the picked-up recording sheet is conveyed to a secondary transfer position 46. The number of paper feed cassettes is not limited to one, and may be plural.

As the recording sheets, recording sheets having different sizes or thicknesses (plain paper, thick paper) and a film sheet such as an OHP sheet can be used. When there are a plurality of paper feed cassettes, recording sheets may separately be stored in the paper feed cassettes according to the size, thickness, and material thereof.

Each of the pick-up roller 42, the timing rollers 44, and the like is driven, by a conveyance motor (not illustrated), to rotate via a power transmission mechanism (not illustrated) such as a gear and a belt. As the conveyance motor, a stepping motor configured to control a rotational speed with a high degree of accuracy is used, for example. The recording sheet is conveyed from the paper feed unit 4 to the secondary transfer position 46 in accordance with a timing at which the toner images formed on the intermediate transfer belt 11 are transferred to the secondary transfer position 46. The toner images formed on the intermediate transfer belt 11 are collectively secondary-transferred onto the recording sheet by the secondary transfer roller 45.

[2] Structure of Fixing Device

Figure 2:
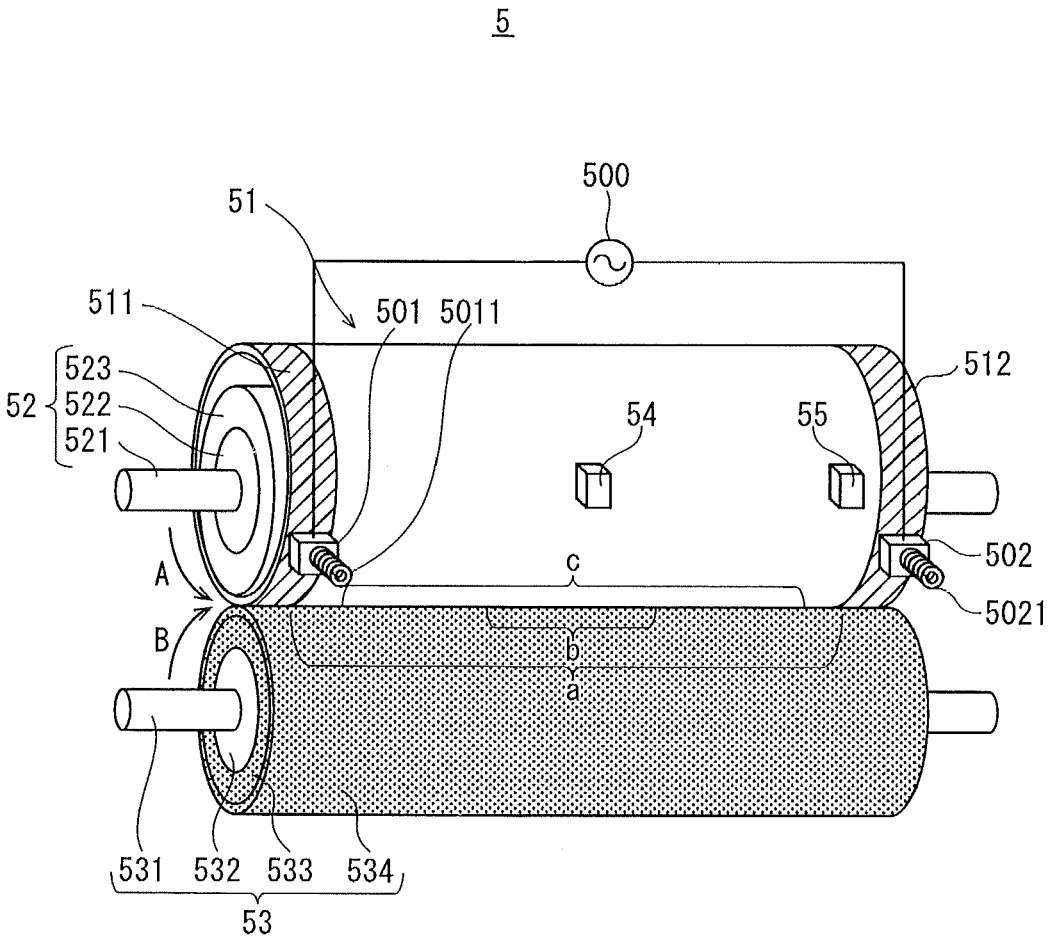
FIG. 2 is a perspective view illustrating the structure of a main part of a fixing device.

FIG. 2 is a perspective view illustrating the structure of a main part of the fixing device. As illustrated in FIG. 2, the fixing device 5 includes the heating rotating body 51, a fixing roller 52, a pressure roller 53, a power supply unit 500 for applying voltage to both ends of the heating rotating body 51 (a resistance heating layer 513 described later), power feeding members 501 and 502 for feeding power to the heating rotating body 51 (electrodes 511 and 512 described later), and temperature sensors 54 and 55. Overall operation of the fixing device 5 is controlled by a fixing control unit 50 described later.

The heating rotating body 51 is an endless belt. The electrodes 511 and 512 for feeding power are provided at respective ends of the heating rotating body 51. Voltage is applied by the power supply unit 500 to the electrodes 511 and 512 via the power feeding members 501 and 502 so that power is fed to the heating rotating body 51. Examples of the power feeding member are a power feeding brush and a power feeding roller made of a copper-graphite material and a carbon-graphite material. Electric current flows between the electrodes by the power feeding via the power feeding members, so that the heating rotating body 51 produces heat by Joule heating. In FIG. 2, a reference sign "a" indicates a range of a Joule heating region of the heating rotating body 51 (hereinafter, referred to as a "heating range") along the rotational axis, a reference sign "b" indicates a range of a region, within the heating region, in which a recording sheet having a minimum size is passed (hereinafter, referred to as a "minimum sheet passing range") along the rotational axis, and a reference sign "c" indicates a range of a region, within the heating region, in which a recording sheet having a maximum size is passed (hereinafter, referred to as a "maximum sheet passing range") along the rotational axis. The ratio (b/a) of the minimum sheet passing range to the heating range is set to 0.30 in this example.

A temperature sensor 54 is disposed to face the outer circumferential surface of the heating rotating body 51 in the heating region within the minimum sheet passing range, without making contact with the heating rotating body 51 (in this example, the temperature sensor 54 is disposed to face the heating rotating body 51 at the center, along the rotational axis, thereof within the minimum sheet passing range.) The temperature sensor 54 detects a surface temperature in the sheet passing region on the outer circumferential surface of the heating rotating body 51. A temperature sensor 55 is disposed to face the outer circumferential surface of the heating rotating body 51 in a part of the heating region outside the maximum sheet passing range along the rotational axis, without contact with the heating rotating body 51. The temperature sensor 55 detects a surface temperature in the non-sheet passing region on the outer circumferential surface of the heating rotating body 51.

Figure 3:
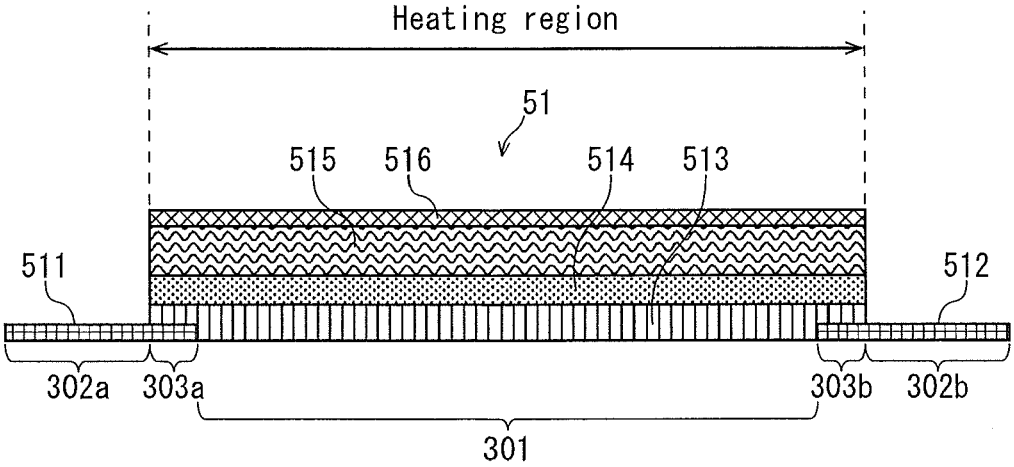
FIG. 3 is a sectional view illustrating the detailed structure of a heating rotating body.

FIG. 3 is a sectional view illustrating the detailed structure of the heating rotating body. As illustrated in FIG. 3, the heating rotating body 51 includes, in a region indicated by a reference sign 301, the resistance heating layer 513, a reinforcing layer 514, an elastic layer 515, and a releasing layer 516 laminated in this order.

The resistance heating layer 513 is a PTC resistance heating layer that produces Joule heat upon receiving power fed by the power supply unit 500 via the electrodes 511 and 512. The resistance heating layer 513 is made of a heat resistant resin and fibrous, acicular, or flaky conductive fillers dispersed in the heat resistant resin so as to be oriented along the rotational axis.

Examples of the heat resistant resin for use in the resistance heating layer 513 are a polyimide resin, a polyethylenesulfide resin, a polyetheretherketone resin, a polyaramid resin, a polysulfone resin, a polyimideamide resin, a polyesterimide resin, a polyphenylene oxide resin, a polyphenylenesulfide resin, a poly-p-xylylene resin, and a polybenzimidazole resin. Among these resins, it is desirable to use the polyimide resin, as it has excellent heat resistance, insulating properties, and mechanical strength.

Used as the conductive fillers are metal, such as silver (Ag), copper (Cu), aluminum (Al), magnesium (Mg), and nickel (Ni), a powder of a carbon compound, such as graphite, carbon black, carbon nanotube, carbon nanofiber, and carbon nanocoil, and a powder of a high ionic conductor of an inorganic compound, such as silver iodide and copper iodide. Two or more types of conductive fillers may be used (e.g. a carbon compound and metal.)

In the present embodiment, metal is used as the conductive fillers so that the resistance heating layer 513 has properties of a PTC resistance heating layer. An NTC material, such as a powder of a carbon compound and a high ionic conductor, may be mixed as long as properties of the PTC resistance heating layer are maintained. As long as the resistance heating layer 513 has properties of the PTC resistance heating layer in a temperature range within which the temperature of the resistance heating layer 513 varies during thermal fixing (e.g. a temperature range from 130° C. to 250° C.), the resistance heating layer 513 may not have the properties of the PTC resistance heating layer at a temperature outside the temperature range.

It is desirable that the conductive fillers be fibrous, acicular, or flaky so that the conductive fillers linearly intertwine with each other to increase the contact probability, compared with the same amount of conductive fillers having a different shape. With this structure, it is possible to form the resistance heating layer 513 having uniform electrical resistance.

For the purpose of regulating the electrical resistivity, conductive particles, such as a metal alloy and an intermetallic compound may be added to the resistance heating layer 513. In order to improve the mechanical strength of the resistance heating layer 513, aluminum nitride, alumina and the like may be added to the resistance heating layer 513. Furthermore, considering safety during manufacturing, an imidizing agent, a coupling agent, a surface active agent, and an antifoaming agent may be added to the resistance heating layer 513. The resistance heating layer 513 is manufactured by uniformly dispersing the conductive fillers in polyimide varnish, which is obtained by polymerizing aromatic tetracarboxylic dianhydride and aromatic diamine in organic solvent, applying the resultant material to a mold, and imidizing the material.

The resistance heating layer 513 may be of any thickness, but it is desirable that the thickness of the resistance heating layer 513 be approximately 30 μm to 150 μm. The electrical resistivity of the resistance heating layer 513 may be set to be within a range of approximately $1.0\times10^{-6}$ Ω·m to $1.0\times10^{-2}$ Ω·m, but it is desirable that the electrical resistivity of the resistance heating layer 513 be within a range of $1.0\times10^{-5}$ Ω·m to $5.0\times10^{-3}$ Ω·m.

The reinforcing layer 514 reinforces the resistance heating layer 513 and ensures insulation. A heat resistant resin, such as a polyimide resin, a polyetheretherketone resin, and a polyphenylenesulfide resin, may be used as the reinforcing layer 514, for example. If the same type of resin as that of the resistance heating layer 513 is used, adhesion to the resistance heating layer 513 can be improved. The reinforcing layer 514 may be of any thickness, but it is desirable that the thickness of the reinforcing layer 514 be approximately 5 μm to 100 μm. If the resistance heating layer 513 has sufficient strength, or insulation of the heating rotating body 51 is ensured, the reinforcing layer 514 may not be provided.

The elastic layer 515 uniformly and flexibly transfers heat to a toner image formed on a recording sheet. Providing the elastic layer 515 prevents a toner image from being squashed or from fusing unevenly, thereby preventing the occurrence of uneven gloss and image noise. A rubber material and a resin material that are heat resistant and elastic may be used as the material for the elastic layer 515. For example, a heat resistant elastomer, such as silicone rubber and fluororubber, may be used as the material for the elastic layer 515.

The thickness of the elastic layer 515 is within a range of 10 μm to 800 μm, and is preferably within a range of 100 μm to 300 μm. The elastic layer 515 with a thickness of less than 10 μm does not have sufficient elasticity in a thickness direction thereof. The elastic layer 515 with a thickness of more than 800 μm is not preferred due to inefficiency of heat transfer as it is difficult to transfer heat generated by the resistance heating layer 513 to the outer circumferential surface of the heating rotating body 51.

The releasing layer 516 is the outermost layer of the heating rotating body 51 and has the function of improving the releasability of a recording sheet from the heating rotating body 51. A material that can withstand use at the fixing temperature and that has excellent releasability with respect to toner may be used as the material for the releasing layer 516. For example, a fluororesin, such as tetrafluoroethylene-perfluoroalkoxyethylene copolymer (PFA), tetrafluoroethylene (PTFE), tetrafluoroethylene-hexafluoroethylene copolymer (FEP), and tetrafluoroethylene-hexafluoropropylene copolymer (PFEP), may be used. The thickness of the releasing layer 516 is within a range of 5 μm to 100 μm, and is preferably within a range of 10 μm to 50 μm. Examples of a fluorine-containing tube include product numbers PFA350-J, 451HP-J, and 951HP Plus by Du Pont-Mitsui Fluorochemicals Co., Ltd. The contact angle with water is 90° C. or greater, and preferably 110° C. or greater. The surface roughness (Ra) is preferably within a range of approximately 0.01 μm to 50 μm.

In regions 302*a* and 302*b* as illustrated in FIG. 3, the electrodes 511 and 512 are each exposed as single layers. In regions 303*a* and 303*b*, the electrodes 511 and 512 are each covered with the resistance heating layer 513 so that the electrode 511 and the resistance heating layer 513, and the electrode 512 and the resistance heating layer 513 overlap each other. The reinforcing layer 514, the elastic layer 515, and the releasing layer 516 are further laminated in this order. A region (a region indicated by a double-headed arrow of FIG. 3) composed of the regions 301, 303*a*, and 303*b* of the heating rotating body 51 corresponds to the Joule heating region of the resistance heating layer 531.

The electrodes 511 and 512 are each made of a material having uniform conductivity in a circumferential direction of the heating rotating body 51. An example of the material having uniform conductivity in the circumferential direction of the heating rotating body 51 used as the material for the electrodes is chemical-plated or electroplated metal such as copper (Cu), aluminum (Al), nickel (Ni), stainless steel (SUS), brass, and phosphor bronze.

As metal for the electrodes, it is desirable to use metal having low electrical resistivity and excellent heat resistance and oxidation resistance, such as nickel, stainless steel, and aluminum. When the electrode is directly provided on the resistance heating layer 513, electroplating should be applied after chemical-plating, It is more desirable to use copper (Cu) and nickel (Ni).

The electrodes may be formed by adhesion of copper (Cu) and nickel (Ni) foils using a conductive adhesive, or by application of a conductive ink or conductive paste. Alternatively, the electrodes may be formed by insert molding of a metal ring made, for example, of stainless steel (SUS), nickel (Ni), aluminum (Al), gold (Au), and silver (Ag).

A thick electrode has high rigidity and is resistant to destruction, but is unlikely to deform at a fixing nip formed by a pressure member. Considering a balance with flexibility, the thickness of the electrode is preferably within a range of 10 μm to 100 μm, and more preferably within a range of approximately 30 μm to 70 μm.

The length of each of the electrodes 511 and 512 along the rotational axis is equal to or more than the length of a corresponding power feeding member along the rotational axis. The length of each electrode in the circumferential direction is arbitrarily set as long as a current density in a contact area does not exceed an allowable current density for a carbon brush. It is preferable that a contact surface be formed along a curved surface of the heating rotating body 51, as the contact area increases and thus current density decreases.

Figure 4:
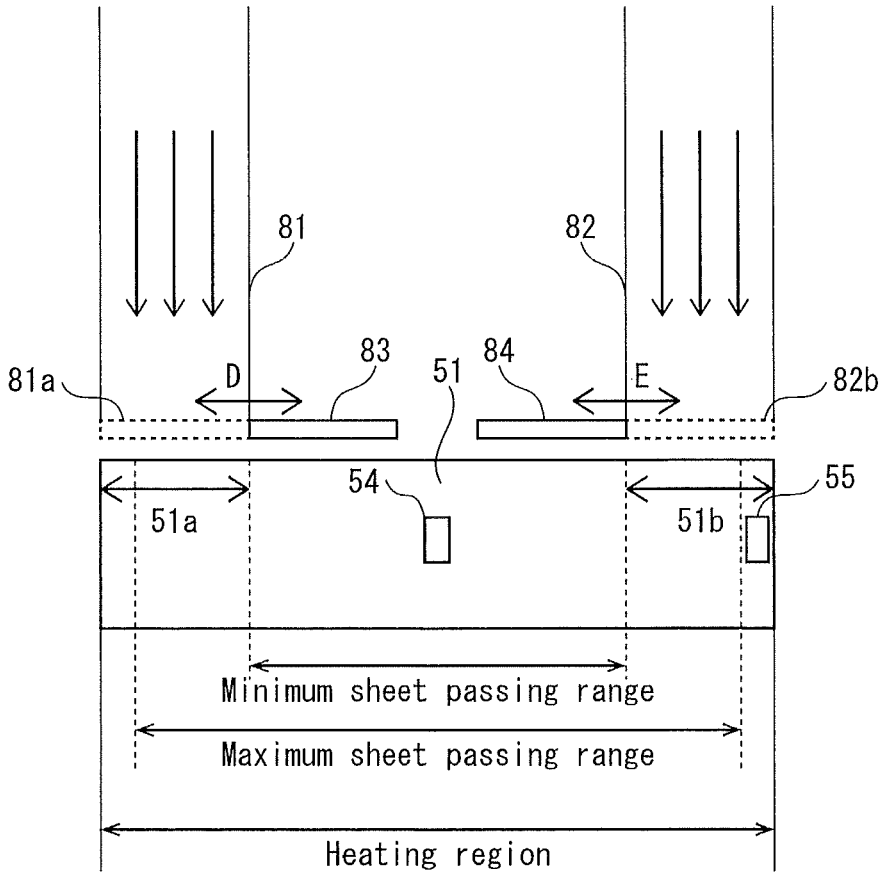
FIG. 4 shows a positional relationship between the heating rotating body and cooling ducts that guide cooling air to the non-sheet passing regions of the heating rotating body.

FIG. 4 shows a positional relationship between the heating rotating body and cooling ducts that guide cooling air to the non-sheet passing regions of the heating rotating body. As illustrated in FIG. 4, the cooling ducts assigned with reference signs 81 and 82 are disposed so that air outlets 81*a* and 82*b* of the cooling ducts 81 and 82, which are openings, face respective heating regions 51*a* and 51*b* located, outside the minimum sheet passing range along the rotational axis, at both ends of the heating rotating body 51 along the rotational axis. With this structure, when a recording sheet having a minimum size is passed to the heating rotating body 51, i.e. when a size of the non-sheet passing region is a maximum size, cooling air sent from the cooling fan 80 can be guided from the air outlets to the entire non-sheet passing regions.

The cooling ducts 81 and 82 are provided with a shutter drive mechanism 800 described later. The shutter drive mechanism 800 drives shutters 83 and 84 to slide along the rotational axis (in directions indicated by double-headed arrows D and E), thereby opening or closing the air outlets 81*a* and 82*b*.

Figure 5:
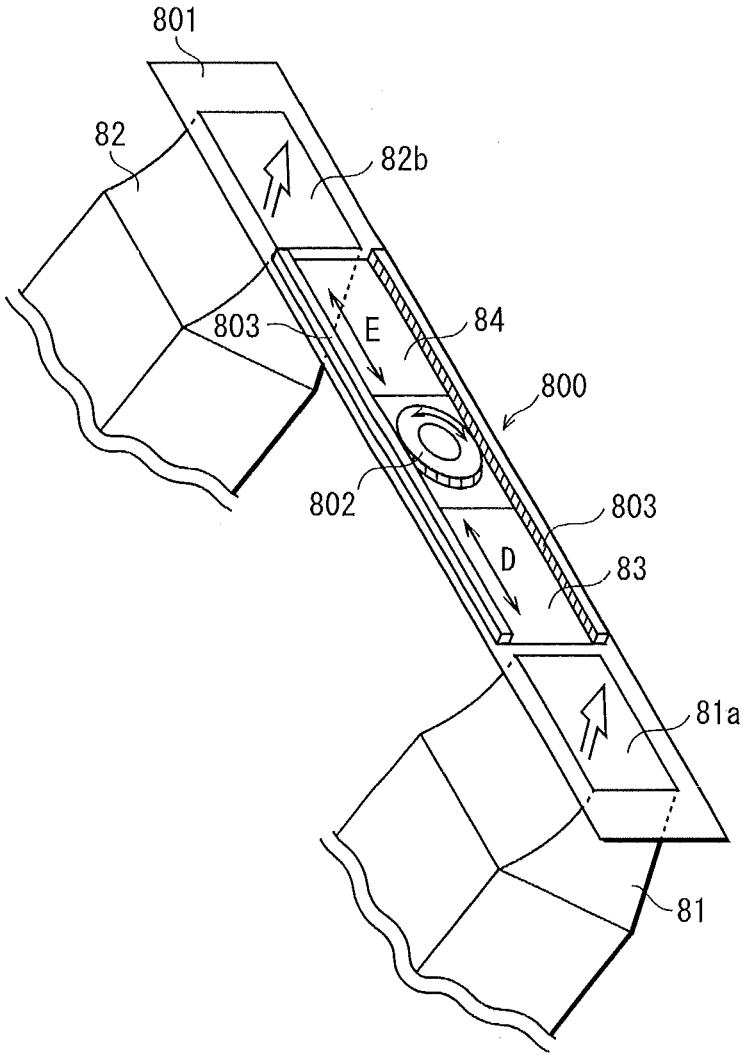
FIG. 5 shows a specific example of a shutter drive mechanism that drives shutters to slide along a rotational axis.

FIG. 5 shows a specific example of the shutter drive mechanism that drives the shutters to slide along the rotational axis. As illustrated in FIG. 5, the shutter drive mechanism 800 includes a supporting plate 801 extending along the rotational axis, a pinion gear 802, rack teeth 803 engaging the pinion gear 802, a pulse motor (not illustrated) driving the pinion gear 802 in a forward or backward direction.

The shutters 83 and 84 are supported by the supporting plate 801 so as to be slidable along a plate surface of the supporting plate 801 in both directions along the rotational axis (in directions indicated by double-headed arrows D and E.) A driving force of the pulse motor is transmitted to the shutters 83 and 84 via a rack and pinion mechanism including the pinion gear 802 and the rack teeth 803, so that the shutters 83 and 84 slide in the both directions along the rotational axis. The sliding amount of the shutters 83 and 84 is controlled by the fixing control unit 50 (described later) controlling rotation of the pulse motor. With this structure, by controlling the rotation of the pulse motor according to the size of the recording sheet passed to the heating rotating body 51, the sliding amount of the shutters 83 and 84 is controlled so that openings of the air outlets 81*a* and 82*b* do not face the sheet passing region and only face the non-sheet passing regions of the heating rotating body 51, and cooling air is guided not to the sheet passing region but to the non-sheet passing regions of the heating rotating body 51.

Referring back to FIG. 4, the temperature sensor 54 is a non-contact temperature sensor for detecting a surface temperature in the sheet passing region. In order to detect the surface temperature regardless of a size of the recording sheet, the temperature sensor 54 is disposed to face the heating rotating body 51 at the center, along the rotational axis, of the heating region within the minimum sheet passing range, without making contact with the heating rotating body 51.

The temperature sensor 55 is a non-contact temperature sensor for detecting a surface temperature in the non-sheet passing region. In order to detect the surface temperature regardless of a size of the recording sheet, the temperature sensor 55 is disposed to face the heating rotating body 51 in a part of the heating region outside the maximum sheet passing range along the rotational axis, without making contact with the heating rotating body 51. As the temperature sensors 54 and 55, an infrared sensor and a non-contact thermistor can be used, for example. A contact temperature sensor (e.g. a contact thermistor) may also be used as the temperature sensor.

Referring back to FIG. 2, the power feeding members 501 and 502 are respectively provided with biasing members 5011 and 5021 for pressing the respective power feeding members toward the inside of the rotational path of the heating rotating body 51. An example of the biasing member is a compression spring. The biasing members 5011 and 5021 bring the power feeding members into contact with the respective electrodes by pressure.

The fixing roller 52 and the pressure roller 53 are each pivotally and rotatably supported by bearings of frames (not illustrated) at both ends 521 and 531 of respective cored bars 522 and 532 along an axis thereof. The pressure roller 53 is driven to rotate in a direction indicated by an arrow B upon receiving a driving force from a drive motor (not illustrated.) Following the rotation of the pressure roller 53, the heating rotating body 51 and the fixing roller 52 are driven to rotate in a direction indicated by an arrow A. Operation of the drive motor for driving the pressure roller 53 to rotate is controlled by the fixing control unit 50 described later.

The fixing roller 52 includes the cored bar 522 which is elongated and cylindrical, and a heat insulating layer 523 covering around the cored bar 522. The fixing roller 52 is provided inside the rotational path of the heating rotating body 51. The cored bar 522 supports the fixing roller 52, and is made of a material having heat resistance and strength. Used as the material for the cored bar 522 are, for example, aluminum, iron, and stainless steel.

The heat insulating layer 523 is provided so as not to allow heat generated by the heating rotating body 51 to escape to the cored bar 522. It is desirable that the heat insulating layer 523 be made of a rubber or resin sponge (insulating structure), which has low thermal conductivity and is resistant to heat and elastic. The heat insulating layer 523 made of such material can tolerate deflection of the heating rotating body 51 and widen a nip. The heat insulating layer 523 may have a double layer structure of a solid body and a sponge. When a silicon sponge is used as the heat insulating layer 523, the thickness of the heat insulating layer 523 is preferably within a range of 1 mm to 10 mm. The thickness of the heat insulating layer 523 is more preferably within a range of 2 mm to 7 mm.

The pressure roller 53 includes a cylindrical cored bar 532, an elastic layer 533, and a releasing layer 534 laminated in this order. The pressure roller 53 is provided outside the rotational path of the heating rotating body 51. The pressure roller 53 externally presses against the fixing roller 52 via an outer circumferential surface of the heating rotating body 51, so that a fixing nip region having a predetermined width in a circumferential direction is foamed between the pressure roller 53 and the outer circumferential surface of the heating rotating body 51.

The cored bar 532 supports the pressure roller 53, and is made of a material having heat resistance and strength. Used as the material for the cored bar 532 are, for example, aluminum, iron, and stainless steel. The cored bar 532 may have a pipe shape and have a thickness of 0.1 mm to 10 mm. Alternatively, the cored bar 532 may be solid, or a cross-section thereof may be a different shape, such as a Y-shape with three spokes extending from the center to an outer ring. The elastic layer 533 is an elastic body with a thickness of 1 mm to 20 mm. The elastic layer 533 is constituted by a highly heat resistant material such as silicone rubber, fluororubber, or the like. The releasing layer 534 is a layer provided to improve the releasability of the recording sheet from the pressure roller 53 and may be formed from the same material and to have the same thickness as the releasing layer 516.

[3] Structure of Control Unit

Figure 6:
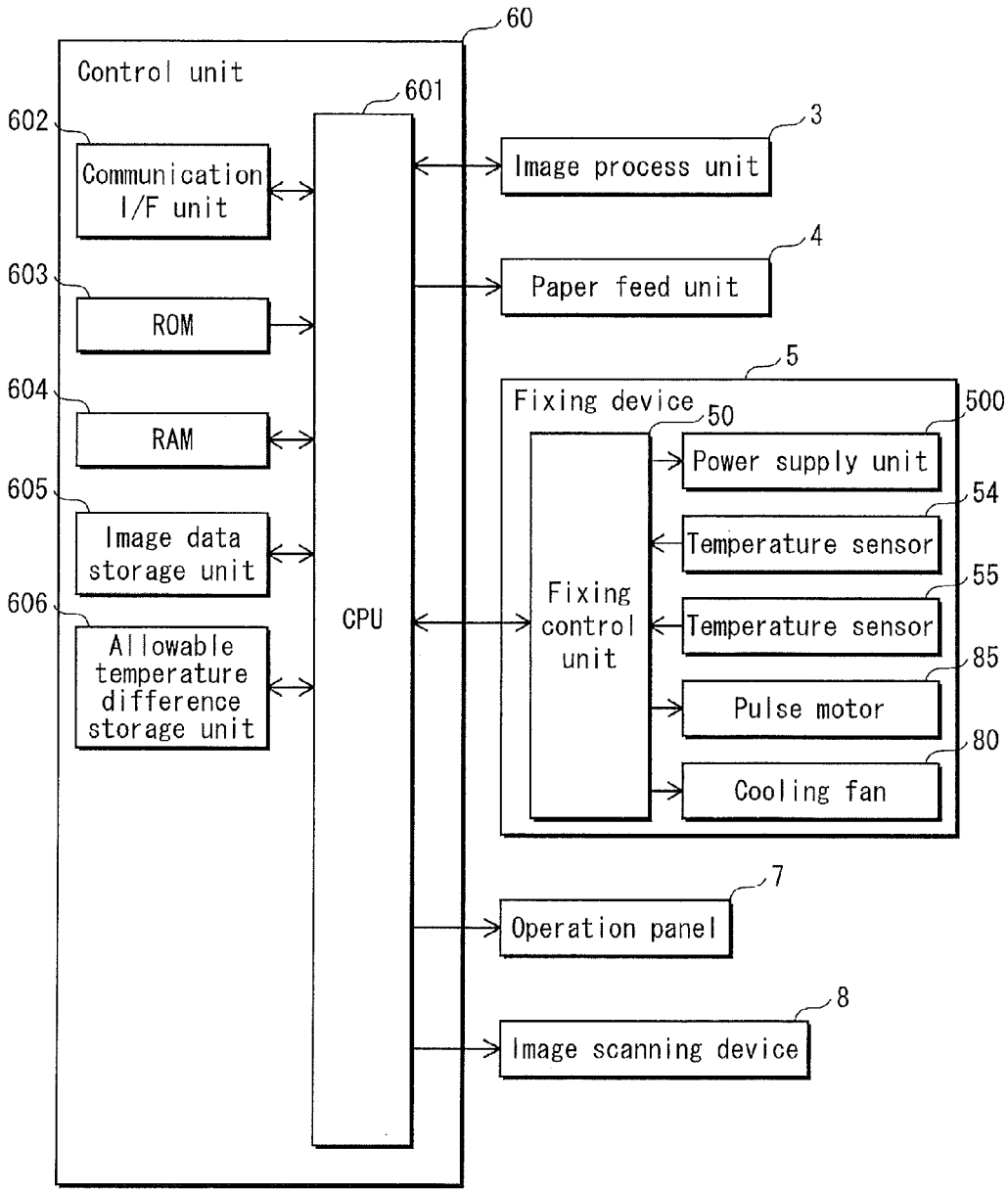
FIG. 6 shows the structure of a control unit, and relationships between the control unit and main components to be controlled by the control unit.

FIG. 6 shows the structure of the control unit, and relationships between the control unit and main components to be controlled by the control unit. The control unit 60 is what is called a computer. As shown in FIG. 6, the control unit 60 includes a Central Processing Unit (CPU) 601, a communication interface (I/F) unit 602, Read Only Memory (ROM) 603, Random Access Memory (RAM) 604, an image data storage unit 605, and an allowable temperature difference storage unit 606.

The communication I/F unit 602 is an interface to connect to a LAN, such as a LAN card and a LAN hoard. Stored in the ROM 603 is a program for controlling the image process unit 3, the paper feed unit 4, the fixing control unit 50, an operation panel 7, an image scanning device 8, and the like.

The RAM 604 is used as a work area of the CPU 601 during execution of the program. The image data storage unit 605 stores therein image data for printing that is input via the communication I/F unit 602 and the image scanning device 8. The allowable temperature difference storage unit 606 stores therein an allowable temperature difference.

The "allowable temperature difference" refers to a tolerance for an absolute value of a difference between a surface temperature in the sheet passing region (a target temperature) and a surface temperature in the non-sheet passing region, and is used to determine whether to open or close the air outlets 81*a* and 82*b* of the respective cooling ducts 81 and 82 in non-sheet passing region cooling control described later. Specifically, the allowable temperature difference is less than an absolute value of a difference between the target temperature and a lower limit of a temperature range over which thermal fixing is successfully performed, and is a maximum temperature difference between the sheet passing region and the non-sheet passing region causing unevenness in resultant gloss that is tolerable (e.g. 20° C.)

The "target temperature" is a temperature at which the surface temperature in the sheet passing region is maintained during thermal fixing. Specifically, the target temperature is set to be a given temperature (e.g. 25° C.) higher than the lower limit of the temperature range over which thermal fixing is successfully performed so that the temperature in the sheet passing region does not fall below the lower limit. The lower limit and the target temperature are set in advance by a manufacturer of the fixing device. In the present embodiment, the lower limit is set to 125° C., and the target temperature is set to 150° C.

The CPU 601 controls the image process unit 3, the paper feed unit 4, the fixing control unit 50, the operation panel 7, the image scanning device 8, and the like by executing various programs stored in the ROM 603. The CPU 601 is configured to intercommunicate with the fixing control unit 50, and controls the fixing device 5 via the fixing control unit 50.

The fixing control unit 50 is what is called a computer, and includes a CPU, ROM, and RAM. The fixing control unit 50 controls the overall operation of the fixing device 5. For example, the fixing control unit 50 (i) controls the rotation of the heating rotating body 51, the fixing roller 52, and the pressure roller 53 by controlling operation of the drive motor to drive the pressure roller 53, (ii) controls operation to drive the cooling fan 80, (iii) monitors temperature in the sheet passing region via the temperature sensor 54 and performs on-off control over the power supply unit 500 for supplying power to the resistance heating layer 513 so that the surface temperature in the sheet passing region is maintained at the target temperature (150° C. in this example) at which thermal fixing is successfully performed.

The fixing control unit 50 further performs the non-sheet passing region cooling control described later. During execution of a print job (during thermal fixing), the fixing control unit 50 monitors the surface temperature in the non-sheet passing region via the temperature sensor 55, controls rotation of the pulse motor 85 based on the result of the monitoring, and performs on-off control over cooling operation to cool the non-sheet passing region by cooling air provided through the cooling ducts 81 and 82 so that the surface temperature in the non-sheet passing region is lower than the target temperature and does not fall below the target temperature by more than the allowable temperature difference.

The operation panel 7 includes a plurality of input keys and a liquid crystal display unit. A touch panel is laminated on a surface of the liquid crystal display unit. The operation panel 7 receives an instruction from a user upon input to a touch panel or to an input key, and notifies the control unit 60 of the received instruction. The image scanning device 8 includes an image input device, such as a scanner. The image scanning device 8 scans information on a character and graphics written to or rendered on the recording sheet, such as a paper, to form image data.

[4] Non-sheet Passing Region Cooling Control

Figure 7:
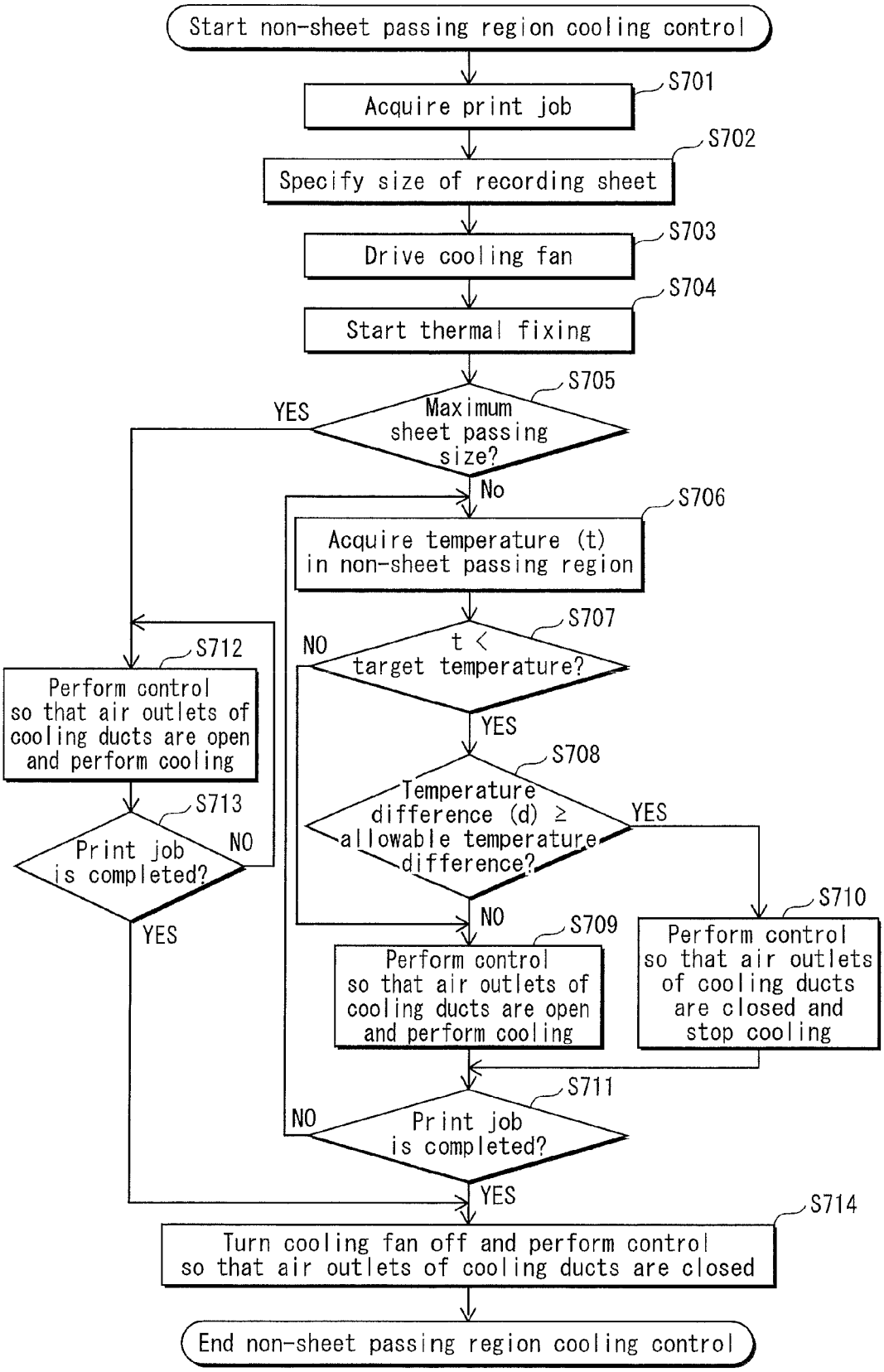
FIG. 7 is a flow chart showing non-sheet passing region cooling control performed by a fixing control unit.

FIG. 7 is a flow chart showing the non-sheet passing region cooling control performed by the fixing control unit. When a print job is acquired from a user via the communication PF unit 602 (step S701), the fixing control unit 50 specifies a size of the recording sheet designated by the print job (step S702.)

The fixing control unit 50 drives the cooling fan 80 (step S703), starts thermal fixing (step S704), and determines whether or not the specified size of the recording sheet is a maximum sheet passing size (step S705.) When the specified size is not the maximum sheet passing size (step S705: NO), the fixing control unit 50 acquires a surface temperature (t) in the non-sheet passing region via the temperature sensor 55 (step S706), and determines whether or not the acquired surface temperature (t) is lower than the target temperature (step S707.)

When the acquired surface temperature (t) is lower than the target temperature (step S707: YES); the fixing control unit 50 further determines whether or not an absolute value of a difference (d) between the target temperature and the acquired surface temperature (t) is equal to or greater than the allowable temperature difference stored in the allowable temperature difference storage unit 606 (step S708.)

When the absolute value of the difference (d) is not equal to or greater than the allowable temperature difference (is smaller than the allowable temperature difference) (step S708: NO), the fixing control unit 50 controls the sliding amount of the shutters 83 and 84 so that the air outlets 81*a* and 82*b* of the respective cooling ducts 81 and 82 are open according to the size of the recording sheet by controlling the rotation of the pulse motor 85 (adjusts opening areas of the air outlets 81*a* and 82*b* by controlling the sliding amount of the shutters 83 and 84 so that openings of the air outlets 81*a* and 82*b* do not face the sheet passing region and only face the non-sheet passing regions of the heating rotation body 51), and cools the non-sheet passing regions by sending cooling air to the non-sheet passing regions from the openings of the air outlets 81*a* and 82*b* (step S709.)

When the absolute value of the difference (d) is equal to or greater than the allowable temperature difference (step S708: YES), the fixing control unit 50 controls the sliding amount of the shutters 83 and 84 so that the openings of the air outlets 81*a* and 82*b* of the respective cooling ducts 81 and 82 are completely closed by controlling the rotation of the pulse motor 85, and stops cooling the non-sheet passing regions by stopping supplying cooling air from the air outlets to the non-sheet passing regions (step S710.)

When the acquired surface temperature (t) in the non-sheet passing region is not lower than the target temperature (is equal to or higher than the target temperature) in step S707, the fixing control unit 50 transitions to processing in step S709.

The fixing control unit 50 repeats processing in steps S706 to S710 until the acquired print job is completed (step S711: YES.) When the acquired print job is completed (step S711: YES), the fixing control unit 50 turns the cooling fan 80 off and controls the sliding amount of the shutters 83 and 84 so that the openings of the air outlets 81*a* and 82*b* of the respective cooling ducts 81 and 82 are completely closed by controlling the rotation of the pulse motor 85 (step S714.)

When the specified size of the recording sheet is the maximum sheet passing size in step S705 (step S705: YES), the fixing control unit 50 controls the sliding amount of the shutters 83 and 84 so that the air outlets 81*a* and 82*b* of the respective cooling ducts 81 and 82 are open by controlling the rotation of the pulse motor 85 (controls the sliding amount of the shutters 83 and 84 so that openings of the air outlets 81*a* and 82*b* do not face the sheet passing region and only face the non-sheet passing regions of the heating rotation body 51), and cools the non-sheet passing regions by sending cooling air to the non-sheet passing regions (step S712) until the acquired print job is completed (step S713: YES.)

As in the present embodiment, when thermal fixing is performed by using the heating rotating body 51 including the PTC resistance heating layer 513, on-off control over cooling operation to cool the non-sheet passing region is performed so that the surface temperature in the non-sheet passing region is lower than the surface temperature in the sheet passing region (target temperature), and an absolute value of a difference between the surface temperature in the sheet passing region (target temperature) and the surface temperature in the non-sheet passing region does not exceed the allowable temperature difference. With this structure, the electrical resistivity is made lower in the non-sheet passing region than in the sheet passing region while maintaining an appropriate temperature difference between the sheet passing region and the non-sheet passing region.

As a result, an increase in power consumption in the non-sheet passing region, which is attributable to an increase in temperature in the non-sheet passing region during thermal fixing, is suppressed. When a size of the recording sheet used for thermal fixing is small, and thus an area of the non-sheet passing region is large, the increase in total power consumption in the non-sheet passing region, which is caused due to the increase in temperature in the non-sheet passing region, is suppressed.

Cooling operation to cool the non-sheet passing region is controlled so that the absolute value of the difference between the surface temperature in the sheet passing region (target temperature) and the surface temperature in the non-sheet passing region does not exceed the allowable temperature difference. With this structure, when thermal fixing onto a large-sized recording sheet immediately follows thermal fixing onto a small-sized recording sheet, the occurrence of uneven gloss on the large-sized recording sheet between regions corresponding to the sheet passing region and the non-sheet passing region of the small-sized recording sheet is prevented, thereby preventing a decrease in image quality.

(Embodiment)

FIG. 8 is a table showing results of research in which the fixing device according to the present embodiment performs thermal fixing onto a recording sheet having a size corresponding to the minimum sheet passing range of the heating rotating body to examine a relationship between temperature in the non-sheet passing region and the power consumption. In the thermal fixing, the target temperature in the sheet passing region of the heating rotating body 51 is set to 150° C. In FIG. 8, reference signs A and B respectively indicate the surface temperatures in the sheet passing region and in the non-sheet passing region.

Reference signs C, D, and E respectively indicate the electrical resistance (Ω) of the resistance heating layer 513 in the entire sheet passing region, in the entire non-sheet passing region, and in the entire region of the heating rotating body 51.

A reference sign F indicates the amount of current (A) flowing through the resistance heating layer 513, and reference signs G, H, and I respectively indicate power supply (W) in the entire sheet passing region, in the entire non-sheet passing region, and in the entire region of the heating rotating body 51.

A reference sign J indicates a percentage indicating a ratio of a current-application time per unit time when on-off control over current-application to the heating rotating body 51 is performed to maintain the surface temperature in the sheet passing region at the target temperature (hereinafter, referred to as an "intermittent current-application ratio".) Reference signs K, L, and M respectively indicate power consumption (Wh) per hour in the entire sheet passing region, in the entire non-sheet passing region, and in the entire region of the heating rotating body 51. The intermittent current-application ratio is set by the fixing control unit 50 so that a predetermined amount of power (150 Wh in the present embodiment) required to maintain the surface temperature in the sheet passing region at the target temperature is supplied to the sheet passing region.

A reference sign N indicates power consumption (Wh) per hour of the cooling fan 80, and a reference sign O indicates total power consumption (Wh) obtained by adding the power consumption of the cooling fan 80 (N) to the power consumption of the heating rotating body as a whole (M).

As shown in the table of FIG. 8, as the surface temperature in the non-sheet passing region increases, the resistance of the PTC resistance heating layer 513 in the entire non-sheet passing region (D) increases, and the total power consumption increases accordingly. In response to this, as in the present embodiment, by cooling the non-sheet passing region by using the cooling fan 80 to perform control so that the difference between the target temperature and the surface temperature in the non-sheet passing region is the allowable temperature difference (20° C.), the total power consumption is reduced compared with a case where the cooling control is not performed.

(Modifications)

Although the present invention has been described based on the above-mentioned embodiment, it is obvious that the present invention is not limited to the above-mentioned embodiment. The following modifications also fall within a scope of the present invention.

(1) In the present embodiment, the heating rotating body 51 includes the PTC resistance heating layer 513, and an increase in total power consumption in the non-sheet passing region, which is caused due to an increase in temperature in the non-sheet passing region, is suppressed by performing the non-sheet passing region cooling control during thermal fixing. The non-sheet passing region cooling control in the present embodiment is applicable to the heating rotating body including the NTC resistance heating layer by making partial modification to the processing.

Figure 9:
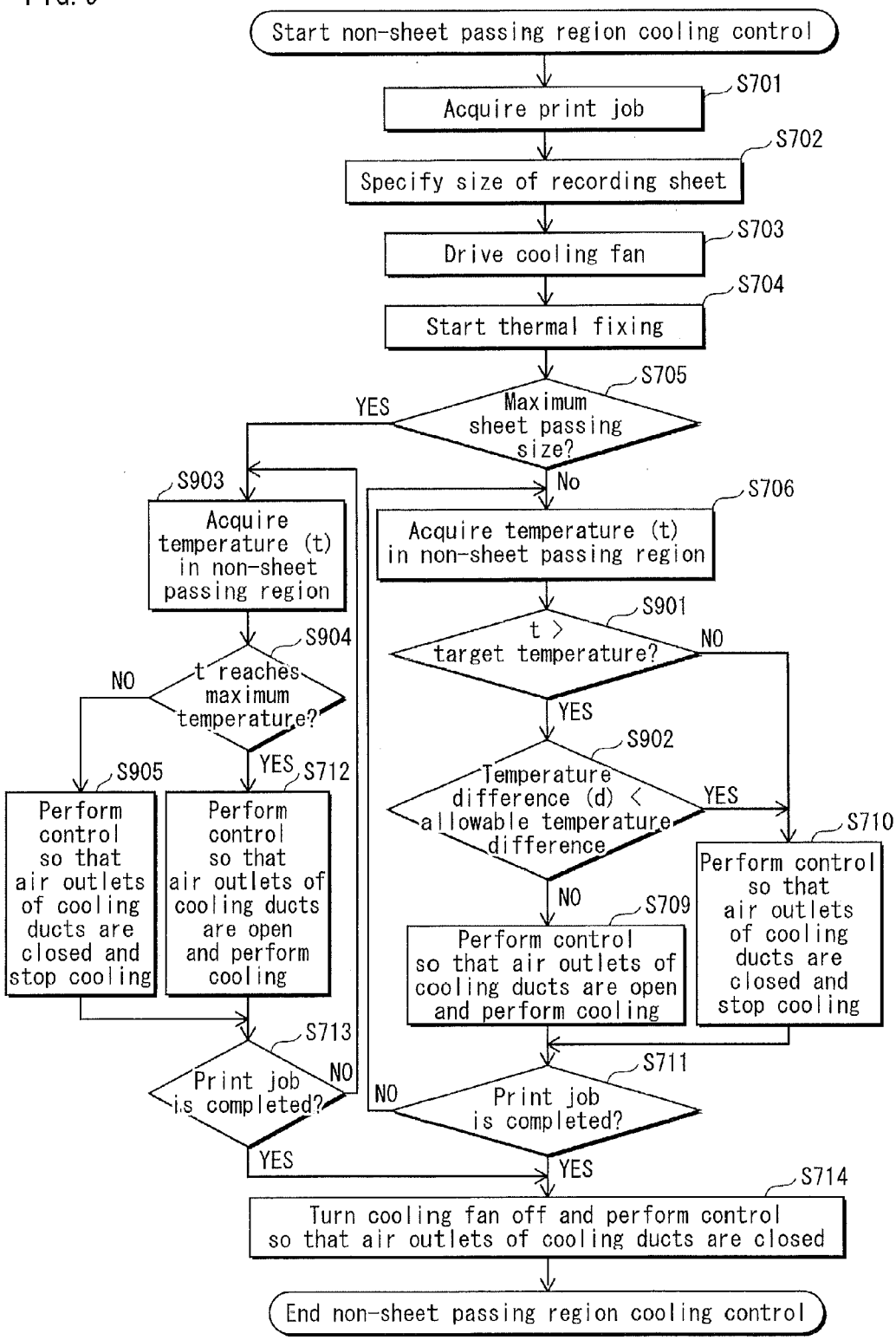
FIG. 9 is a flow chart showing the non-sheet passing region cooling control performed by the fixing control unit when an NTC resistance heating layer is used.

FIG. 9 is a flow chart showing the non-sheet passing region cooling control performed by the fixing control unit when the NTC resistance heating layer is used. The same step as that of the non-sheet passing region cooling control shown in FIG. 7 is assigned with the same step number. The following describes differences from the non-sheet passing region cooling control shown in FIG. 7. After performing processing in step S706, the fixing control unit 60 determines whether or not the surface temperature (t) in the non-sheet passing region is higher than the target temperature (step S901.)

When the surface temperature (t) is higher than the target temperature (step S901: YES), the fixing control unit 50 further determines whether or not an absolute value of a difference (d) between the target temperature and the surface temperature (t) is smaller than the allowable temperature difference stored in the allowable temperature difference storage unit 606 (step S902.)

When the absolute value of the difference (d) is not smaller than the allowable temperature difference (is equal to or greater than the allowable temperature difference) (step S902: NO), the fixing control unit 50 transitions to processing in step S709. When the absolute value of the difference (d) is smaller than the allowable temperature difference (step S902: YES), the fixing control unit 50 transitions to processing in step S710.

When the size of the recording sheet is the maximum sheet passing size in step S705 (step S705: YES), the fixing control unit 50 acquires a surface temperature (t) in the non-sheet passing region via the temperature sensor 55 (step S903), and determines whether or not the acquired surface temperature (t) reaches a maximum temperature (250° C. in this example) at which any component of the fixing device 5 can deteriorate by heat (step S904.)

When the surface temperature (t) reaches the maximum temperature (step S904: YES), the fixing control unit 50 transitions to processing in step S712. When the surface temperature (t) does not reach the maximum temperature (step S904: NO), the fixing control unit 50 controls the sliding amount of the shutters 83 and 84 so that the openings of the air outlets 81*a* and 82*b* of the respective cooling ducts 81 and 82 are completely closed by controlling the rotation of the pulse motor 85, and stops cooling the non-sheet passing region by stopping supplying cooling air from the air outlets to the non-sheet passing regions (step S905.)

The fixing control unit 50 repeats processing in steps S903, S904, S712, and S905 until the print job is completed (step S713: YES.)

In modification shown in FIG. 9, the allowable temperature difference is a maximum temperature difference causing unevenness in resultant gloss that is tolerable (e.g. 20° C.) The allowable temperature difference may be an absolute value of a difference between the target temperature and the surface temperature in the non-sheet passing region causing heat deterioration of any component of the fixing device (for example, when the temperature in the non-sheet passing region at which the heat deterioration is caused is 250° C., the absolute value of the difference from the target temperature (150° C.) is 100° C.).

Alternatively, the allowable temperature difference may be an absolute value of a difference between the surface temperature in the non-sheet passing region and the target temperature causing the amount of current flowing through the resistance heating layer to be equal to a standard value (e.g. rated current.) In this case, the absolute value of the temperature difference is determined by conducting, in advance, a study to obtain a relationship between the temperature in the non-sheet passing region and the amount of current flowing through the resistance heating layer, and, based on the results of the study, finding the surface temperature in the non-sheet passing region when the amount of current reaches the rated current.

When the NTC resistance heating layer is used, the total power consumption decreases as the surface temperature in the non-sheet passing region increases, but the following problems occur. If the surface temperature in the non-sheet passing region excessively increases, when the thermal fixing onto a large-sized recording sheet immediately follows thermal fixing onto a small-sized recording sheet, uneven gloss can occur on the large-sized recording sheet between regions corresponding to the sheet passing region and the non-sheet passing region of the small-sized recording sheet, due to an increase in temperature difference between the sheet passing region and the non-sheet passing region. In addition, if the non-sheet passing region is excessively heated, components of the fixing device and peripheral components are likely to deteriorate by heat, leading to a problem, such as a decrease in durability of the components.

Furthermore, if the surface temperature in the non-sheet passing region excessively increases, the electrical resistivity might excessively decrease in the non-sheet passing region. As a result, the amount of current flowing through the resistance heating layer might increase and exceed a standard value (e.g. rated current.)

When the NTC resistance heating layer is used, it is also necessary to perform the non-sheet passing region cooling controlling as in the present embodiment to prevent the surface temperature in the non-sheet passing region from excessively increasing.

As in the present modification, when the heating rotating body 51 including the NTC resistance heating layer is used to perform thermal fixing, on-off control over cooling operation to cool the non-sheet passing region is performed so that the surface temperature in the non-sheet passing region is higher than the surface temperature in the sheet passing region (target temperature), and an absolute value of a difference between the surface temperature in the sheet passing region (target temperature) and the surface temperature in the non-sheet passing region does not exceed the allowable temperature difference. With this structure, the electrical resistivity is made lower in the non-sheet passing region than in the sheet passing region while maintaining an appropriate temperature difference between the sheet passing region and the non-sheet passing region.

As a result, when the NTC resistance heating layer is used, an increase in power consumption in the non-sheet passing region, which is attributable to excessive cooling of the non-sheet passing region during thermal fixing, is suppressed.

Furthermore, the cooling operation to cool the non-sheet passing region is controlled so that the surface temperature in the non-sheet passing region does not exceed, by heating, the surface temperature in the sheet passing region (target temperature) by more than the maximum temperature difference between the sheet passing region and the non-sheet passing region causing unevenness in resultant gloss that is tolerable. With this structure, when thermal fixing onto a large-sized recording sheet immediately follows thermal fixing onto a small-sized recording sheet, the occurrence of uneven gloss on the large-sized recording sheet between regions corresponding to the sheet passing region and the non-sheet passing region of the small-sized recording sheet is prevented.

FIG. 10 is a table showing results of research in which thermal fixing onto the recording sheet having the size corresponding to the minimum sheet passing range is performed by using the heating rotating body using the NTC resistance heating layer to examine a relationship between temperature in the non-sheet passing region and the power consumption. Reference sings A to N are similar to those shown in FIG. 8. Description thereof is thus omitted. As shown in the table of FIG. 10, as the surface temperature in the non-sheet passing region increases, the resistance of the NTC resistance heating layer in the entire non-sheet passing region (D) decreases, and the total power consumption decreases accordingly. In response to this, the non-sheet passing region cooling control as shown in FIG. 9 is performed. By cooling the non-sheet passing region by using the cooling fan 80 while maintaining the surface temperature in the non-sheet passing region at a temperature higher than the target temperature to perform control so that the difference between the target temperature and the surface temperature in the non-sheet passing region does not exceed the allowable temperature difference (20° C.), the total power consumption can be reduced, compared with a case where the temperature in the non-sheet passing region is maintained at the target temperature (150° C.)

(2) In the present embodiment, the non-sheet passing region cooling control is performed with respect to the fixing device 5 in which the resistance heating layer 513 is formed inside the heating rotating body 51. The non-sheet passing region cooling control in the present embodiment, however, is not limited to the above-mentioned example, and is widely applicable to the fixing device including the heating rotating body using the resistance heating element as a heat source.

Figure 11:
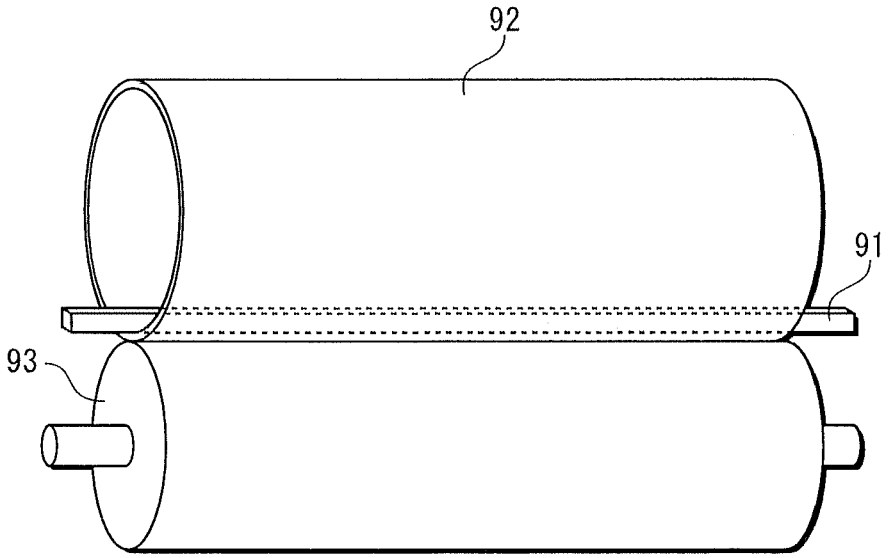
FIG. 11 illustrates a modification of the heating rotating body using a resistance heating element as a heat source.

For example, as illustrated in FIG. 11, the non-sheet passing region cooling control in the present embodiment is applicable to the fixing device 5 in which the resistance heating layer is formed inside a rod-shaped heating member 91 extending along the rotational axis, and an endless fixing belt 92 (the heating rotating body) that is driven to rotate is externally heated by the heating member 91.

In the fixing device as illustrated in FIG. 11, the heating member 91 is provided inside the rotational path of the fixing belt 92. The heating member 91 is pressed against the pressure roller 93 via the fixing belt 92 to form a fixing nip between an outer circumferential surface of the fixing belt 92 and an outer circumferential surface of the pressure roller 93. The heating member 91 also includes an insulating layer to ensure insulation of the resistance heating layer.

Although the temperature sensors and the cooling ducts are omitted from FIG. 11, by providing these components at positions similar to those in the present embodiment, cooling air is guided from the cooling ducts to the non-sheet passing regions of the fixing belt 92, thereby performing the non-sheet passing region cooling control as in the present embodiment. The structure as illustrated in FIG. 11 is applicable to the modification (1).

The non-sheet passing region cooling control in the present embodiment and in the modification (1) is applicable not only to a belt-type heating rotating body but also a roller-type heating rotating body.

(3) In the present embodiment, the allowable temperature difference is the maximum temperature difference causing unevenness in resultant gloss that is tolerable, and on-off control over cooling operation to cool the non-sheet passing region is performed so that the difference between the surface temperature in the sheet passing region (target temperature) and the surface temperature in the non-sheet passing region does not exceed the allowable temperature difference. However, the allowable temperature difference may be an absolute value of a difference between the target temperature and a lower limit of a temperature range over which thermal fixing is successfully performed (e.g. 25° C. or 30° C.)

In this case, the cooling operation to cool the non-sheet passing region is controlled so that the surface temperature in the non-sheet passing region does not fall, by excessive cooling, below the lower limit of the temperature range over which thermal fixing is successfully performed. With this structure, when thermal fixing onto a large-sized recording sheet immediately follows thermal fixing onto a small-sized recording sheet, the occurrence of unevenness in fixing on the large-sized recording sheet between regions corresponding to the sheet passing region and the non-sheet passing region of the small-sized recording sheet is prevented, thereby preventing a decrease in image quality.

Alternatively, the allowable temperature difference may be an absolute value of a difference between the target temperature and the surface temperature in the non-sheet passing region causing the amount of current flowing through the resistance heating layer to be equal to a standard value (e.g. rated current.) The absolute value of the difference is determined in a similar manner to the modification (1).

With this structure, it is possible to prevent occurrence of such a problem that the electrical resistivity excessively decreases in the non-sheet passing region by excessive cooling, and the amount of current flowing through the resistance heating layer 513 exceeds the standard value (e.g. rated current.)

(4) In the present embodiment and in the modifications (1), (2), and (3), the non-sheet passing region is directly cooled by the cooling air sent via the cooling ducts 81 and 82 used as a cooling unit in the non-sheet passing region cooling control. The cooling ducts 81 and 82, however, may be provided in the pressure roller 53 to cool a region, of an outer circumferential surface of the pressure roller 53, corresponding to the non-sheet passing region of the heating rotating body 51, thereby indirectly cooling the non-sheet passing region of the heating rotating body pressed against the cooled region.

As in the present embodiment, the cooling ducts may be provided with the shutters 83 and 84, and the shutter drive mechanism 800. The sliding amount of the shutters 83 and 84 may be controlled according to a size of the recording sheet so that openings of the air outlets 81*a* and 82*b* of the cooling ducts only face regions on the outer circumferential surface of the pressure roller 53 corresponding to the non-sheet passing regions to guide cooling air only to the corresponding regions.

With this structure, the heating rotating body 51 is cooled by cooling air sent from a distant position. Compared to a case where the cooling duet is provided in the heating rotating body 51, the effects of cooling air on the sheet passing region can be reduced. As a result, an increase in power consumption in the non-sheet passing region, which is attributable to a temperature change in the non-sheet passing region during thermal fixing, is suppressed. Since the effects of cooling air are reduced, the amount of power required to maintain the temperature in the sheet passing region at the target temperature is reduced accordingly.

(5) In the present embodiment and in the modifications (1), (2), (3), and (4), the non-sheet passing region is cooled by the cooling air sent via the cooling ducts used as a cooling unit in the non-sheet passing region cooling control. The non-sheet passing region, however, may directly be cooled by cooling air sent from the cooling fan without providing the cooling ducts.

In the present embodiment and in the modifications (1), (2), (3), and (4), the cooling fan 80 is used for both cooling of the non-sheet passing region and cooling of the recording sheet after thermal fixing. Cooling air, however, may be guided by the cooling ducts 81 and 82 from a cooling fan exclusively for cooling of the non-sheet passing region.

In each of the above-mentioned modifications, power charged by using a thermoelectric conversion element may be supplied to the cooling fan.

(6) In the present embodiment and in the modifications (1), (2), (3), and (4), opening areas of the air outlets 81*a* and 82*b* of the respective cooling ducts 81 and 82 are adjusted by controlling the sliding amount of the shutters 83 and 84 according to a size of the recording sheet, and on-off control over cooling operation to cool the non-sheet passing region is performed by opening or closing the shutters 83 and 84. In place of the shutters, however, each air outlet may be provided with a cooling air direction changing member that can change a direction of cooling air, and a position of the changing member may be controlled by the fixing control unit 50. The on-off control over cooling operation to cool the non-sheet passing region is performed by changing a direction of cooling air according to the size of the recording sheet so that cooling is guided or not guided to the heating rotating body 51 or the pressure roller 53.

(7) In the present embodiment and in the modifications (1), (2), (3), (4), (5), and (6), cooling operation of the non-sheet passing region is controlled by performing on-off control over the cooling operation to cool the non-sheet passing region. Cooling operation of the non-sheet passing region, however, may be controlled by changing the degree of cooling according to the surface temperature in the non-sheet passing region. For example, the degree of cooling of the non-sheet passing region may be changed by changing an opening area of each air outlet of the cooling duct, the strength of cooling air sent from the cooling fan, and a direction of cooling air.

(8) In the present embodiment, the heating range is greater than the maximum sheet passing range. The heating range, however, may be equal to the maximum sheet passing range. That is to say, when the size of the recording sheet corresponds to the maximum sheet passing range, the size of the heating rotating body 51 along the rotational axis may be adjusted so that there is no non-sheet passing region. In this case, in the non-sheet passing region cooling control in the present embodiment and in the modifications (1), (2), (3), (4), (5), and (6), when the size of the recording sheet corresponds to the maximum sheet passing range, cooling operation of the non-sheet passing region is turned off.

Figure 12:
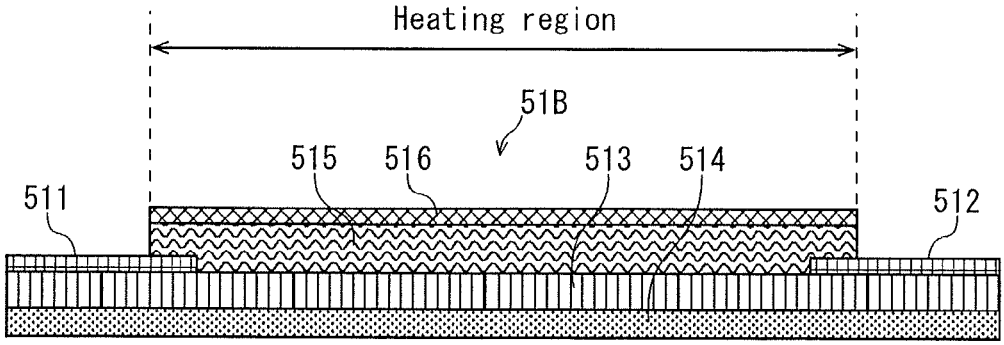
FIG. 12 illustrates a modification of the structure of the heating rotating body.

(9) The heating rotating body 51 in the present embodiment has the structure in which the reinforcing layer 514 is laminated on the resistance heating layer 513, and the electrodes 511 and 512 are each partially exposed as single layers. The structure of the heating rotating body, however, is not limited to the above-mentioned structure, and may have another structure. For example, the heating rotating body may have a structure as illustrated in FIG. 12. Since components of a heating rotating body 51B as illustrated in FIG. 12 are the same as the respective components of the heating rotating body 51, the same reference signs as those of the heating rotating body 51 are assigned to the components of the heating rotating body 51B. As illustrated in FIG. 12, the heating rotating body 51B has the structure in which the resistance heating layer 513 is laminated on the reinforcing layer 514, and the electrodes 511 and 512 are each formed on the resistance heating layer 513. A region indicated by a double-headed arrow of FIG. 12 is the heating region of the heating rotating body 51B.

<Summary>

A fixing device according to one aspect of the present invention disclosed above is a fixing device that thermally fixes an unfixed image onto a recording sheet by pressing the recording sheet against a heating rotating body during passage of the recording sheet, the heating rotating body using, as a heat source, a resistance heating element whose electrical resistivity varies with temperature, the fixing device comprising: a temperature monitoring unit configured to monitor temperature in a sheet passing region and in a non-sheet passing region of the heating rotating body; a power supply unit configured to supply power to the resistance heating element so that the temperature in the sheet passing region is maintained at a target temperature during thermal fixing; a cooling unit configured to cool the non-sheet passing region; and a control unit configured to control cooling operation of the cooling unit according to the temperature in the non-sheet passing region during thermal fixing so that (i) the electrical resistivity of the resistance heating element is lower in a region corresponding to the non-sheet passing region than in a region corresponding to the sheet passing region and (ii) an absolute value of a temperature difference between the sheet passing region and the non-sheet passing region does not exceed an allowable temperature difference.

The resistance heating element may be a positive temperature coefficient (PTC) element, and the control unit may control the cooling operation so that the temperature in the non-sheet passing region is lower than the target temperature.

The resistance heating element may be a negative temperature coefficient (NTC) element, and the control unit may control the cooling operation so that the temperature in the non-sheet passing region does not exceed the target temperature by more than the allowable temperature difference.

The heating rotating body may be an endless belt. An image forming apparatus according to another aspect of the present invention may be an image forming apparatus including the above-mentioned fixing device.

With the above-mentioned structure, the cooling operation of the cooling unit is controlled according to the temperature in the non-sheet passing region during thermal fixing so that (i) the electrical resistivity of the resistance heating element is lower in the region corresponding to the non-sheet passing region than in the region corresponding to the sheet passing region and (ii) the absolute value of the temperature difference between the sheet passing region and the non-sheet passing region does not exceed the allowable temperature difference. Accordingly, the power consumption rate per unit area during thermal fixing is made lower in the non-sheet passing region than in the sheet passing region while maintaining an appropriate temperature difference between the sheet passing region and the non-sheet passing region. As a result, an increase in power consumption in the non-sheet passing region, which is attributable to an increase in temperature in the non-sheet passing region during thermal fixing, is suppressed. When a size of the recording sheet used for thermal fixing is small, and thus an area of the non-sheet passing region is large, an increase in total power consumption in the non-sheet passing region, which is attributable to a temperature change in the non-sheet passing region, is suppressed.

The allowable temperature difference may be an absolute value of a difference between the target temperature and a lower limit of a temperature range over which thermal fixing is successfully performed.

With this structure, the cooling operation of the cooling unit is controlled so that the temperature in the non-sheet passing region of the heating rotating body does not fall below the lower limit of the temperature range over which thermal fixing is successfully performed. Accordingly, when the thermal fixing onto a large-sized recording sheet immediately follows the thermal fixing onto a small-sized recording sheet, it is possible to prevent the occurrence of defective fixing in a region on the large-sized recording sheet corresponding to the non-sheet passing region, which is attributable to excessive cooling of the non-sheet passing region.

The allowable temperature difference may be a maximum temperature difference between the sheet passing region and the non-sheet passing region causing unevenness in resultant gloss that is tolerable.

With this structure, the cooling operation of the cooling unit is controlled according to the temperature in the non-sheet passing region of the heating rotating body so that the absolute value of the difference between the temperature in the sheet passing region (target temperature) and the temperature in the non-sheet passing region does not exceed the maximum temperature difference between the sheet passing region and the non-sheet passing region causing unevenness in resultant gloss that is tolerable. Accordingly, when thermal fixing onto a large-sized recording sheet immediately follows thermal fixing onto a small-sized recording sheet, the occurrence of uneven gloss of an image formed on the large-sized recording sheet after thermal fixing is prevented.

The cooling unit may include: a cooling fan that sends cooling air upon being driven during thermal fixing; a duct that guides the cooling air to the non-sheet passing region; and a shutter that opens or closes an air outlet of the duct, and the control unit controls the cooling operation by controlling opening-closing operation of the shutter.

With this structure, since the cooling air is directly guided by the duct to the non-sheet passing region of the heating rotating body, the non-sheet passing region is cooled rapidly.

The fixing device may further comprise a pressure rotating body that presses against the heating rotating body to form a fixing nip therebetween, wherein the cooling unit may include: a cooling fan that sends cooling air upon being driven during thermal fixing; a duct that guides the cooling air to a region of the pressure rotating body corresponding to the non-sheet passing region; and a shutter that opens or closes an air outlet of the duct, and the control unit controls the cooling operation by controlling opening-closing operation of the shutter.

With this structure, the non-sheet passing region of the heating rotating body is indirectly cooled by cooling the region of the pressure rotating body corresponding to the non-sheet passing region by the cooling air guided by the duct, the heating rotating body is cooled by the cooling air sent from a distant position. Accordingly, the effects of the cooling air on the sheet passing region of the heating rotating body can be reduced. As a result, since the effects of cooling air are reduced, the amount of power required to maintain the temperature in the sheet passing region of the heating rotating body at the target temperature can be reduced accordingly.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A fixing device that thermally fixes an unfixed image onto a recording sheet by pressing the recording sheet against a heating rotating body during passage of the recording sheet, the heating rotating body using, as a heat source, a resistance heating element whose electrical resistivity varies with temperature, the fixing device comprising:

a temperature monitoring unit configured to monitor temperature in a sheet passing region and in a non-sheet passing region of the heating rotating body;

a power supply unit configured to supply power to the resistance heating element so that the temperature in the sheet passing region is maintained at a target temperature during sheet passing with thermal fixing;

a cooling unit configured to cool the non-sheet passing region; and a control unit configured to control cooling operation of the cooling unit according to the temperature in the non-sheet passing region during sheet passing with thermal fixing so that (i) the electrical resistivity of the resistance heating element is lower in a region corresponding to the non-sheet passing region than in a region corresponding to the sheet passing region and (ii) an absolute value of a temperature difference between the sheet passing region and the non-sheet passing region does not exceed an allowable temperature difference, wherein the resistance heating element is a positive temperature coefficient (PTC) element, and the control unit controls the cooling operation so that the temperature in the non-sheet passing region is lower than the target temperature.

2. The fixing device of claim 1, wherein the allowable temperature difference is an absolute value of a difference between the target temperature and a lower limit of a temperature range over which sheet passing with thermal fixing is successfully performed.

3. The fixing device of claim 1, wherein the cooling unit includes:

a cooling fan that sends cooling air upon being driven during sheet passing with thermal fixing;

a duct that guides the cooling air to the non-sheet passing region; and a shutter that opens or closes an air outlet of the duct, and the control unit controls the cooling operation by controlling opening-closing operation of the shutter.

4. The fixing device of claim 1 further comprising a pressure rotating body that presses against the heating rotating body to form a fixing nip therebetween, wherein the cooling unit includes:

a cooling fan that sends cooling air upon being driven during sheet passing with thermal fixing;

a duct that guides the cooling air to a region of the pressure rotating body corresponding to the non-sheet passing region; and a shutter that opens or closes an air outlet of the duct, and the control unit controls the cooling operation by controlling opening-closing operation of the shutter.

5. The fixing device of claim 1, wherein the heating rotating body is an endless belt.

6. The fixing device of claim 1, wherein the control unit controls the cooling operation so that temperature difference between the sheet passing region and the non-sheet passing region does not exceed the allowable temperature difference when sheet passing with thermal fixing is performed.

7. An image forming apparatus that thermally fixes an unfixed image onto a recording sheet by pressing the recording sheet against a heating rotating body during passage of the recording sheet, the heating rotating body using, as a heat source, a resistance heating element whose electrical resistivity varies with temperature, the image forming apparatus comprising:

a temperature monitoring unit configured to monitor temperature in a sheet passing region and in a non-sheet passing region of the heating rotating body;

a power supply unit configured to supply power to the resistance heating element so that the temperature in the sheet passing region is maintained at a target temperature during sheet passing with thermal fixing;

a cooling unit configured to cool the non-sheet passing region; and a control unit configured to control cooling operation of the cooling unit according to the temperature in the non-sheet passing region during sheet passing with thermal fixing so that (i) the electrical resistivity of the resistance heating element is lower in a region corresponding to the non-sheet passing region than in a region corresponding to the sheet passing region and (ii) an absolute value of a temperature difference between the sheet passing region and the non-sheet passing region does not exceed an allowable temperature difference, wherein the resistance heating element is a positive temperature coefficient (PTC) element, and the control unit controls the cooling operation so that the temperature in the non-sheet passing region is lower than the target temperature.

8. The image forming apparatus of claim 7, wherein the control unit controls the cooling operation so that temperature difference between the sheet passing region and the non-sheet passing region does not exceed the allowable temperature difference when sheet passing with thermal fixing is performed.

* * * * *